US006244699B1

(12) United States Patent
Brugue et al.

(10) Patent No.: US 6,244,699 B1
(45) Date of Patent: Jun. 12, 2001

(54) MODULAR REMOVABLE ROLLFEED APPARATUS FOR A PRINTER

(75) Inventors: Joaquim Brugue, Barcelona; David Claramunt, Sant Esteves ses Rovires, both of (ES)

(73) Assignee: Hewlett-Packard Company

( * ) Notice: Subject to any disclaimer, the term of this patent is extended or adjusted under 35 U.S.C. 154(b) by 0 days.

(21) Appl. No.: 08/922,231

(22) Filed: Sep. 2, 1997

(51) Int. Cl.[7] ..... B41J 2/01
(52) U.S. Cl. ..... 347/101; 347/104
(58) Field of Search ..... 347/101, 104, 347/1, 108, 152, 245, 138, 170, 222, 263; 242/598.3, 598.4, 598.5; 400/613, 584, 585, 585.1, 594, 594.1, 621, 605, 607, 611, 692; 346/136, 134, 139 R, 1.1; 235/10, 146; 248/677, 688; 353/310

(56) References Cited

U.S. PATENT DOCUMENTS 4,277,034 * 7/1981 Buzzell ..... 242/598.3
4,632,585 * 12/1986 Oyamatsu et al. ..... 400/613
4,703,919 * 11/1987 Drake et al. ..... 248/677
5,187,532 * 2/1993 McNew ..... 355/309
5,810,494 * 9/1998 Menard et al. ..... 400/634
5,815,186 * 9/1998 Lewis et al. ..... 347/101

* cited by examiner

*Primary Examiner*—John Barlow
*Assistant Examiner*—Juanita Stephens

(57) ABSTRACT

A removable rollfeed adapted to be attached to a printer comprising a pair of rollfeed supports, each having means for holding an end of a media shaft, wherein each said rollfeed support is independently mountable on a printer. Independent mounting considerably eases the task of attaching or removing the rollfeed apparatus from a printer since only one relatively small support need be handled and aligned with the printer at a time. No strengthening or stiffening members are required between the two rollfeed supports since the printer itself provides sufficient structural integrity between the supports once they are mounted on the printer. Preferably the rollfeed supports are slidably mountable to the underside of the printer.

17 Claims, 16 Drawing Sheets

MODULAR REMOVABLE ROLLFEED APPARATUS FOR A PRINTER

FIELD OF THE INVENTION

The present invention relates to a removable rollfeed apparatus for a printer and to a method of attaching such apparatus, and in particular to rollfeed apparatus having a pair of independently mountable rollfeed supports.

BACKGROUND TO INVENTION

Printers such as inkjet printers which print on a variety of print media such as paper, vellum or film are well known. Some larger printers, sometimes known as large-format printers, as well as accepting print media in single sheet format, also accept print media fed from a roll of media held by a rollfeed apparatus. The rollfeed apparatus releasably holds both ends of a shaft on which a roll of media is mounted and may provide braking to the rotation of the shaft to improve the feeding of media into the printer. The more expensive of these printers often integrally include such rollfeed apparatus when the printer is sold. However for less expensive models of printer which are sold without an integral rollfeed apparatus, or in order to provide a greater choice of models to a customer, it is known to provide a removal rollfeed apparatus.

Commonly assigned application U.S. 08/658,346, filed Apr. 29, 1996, entitled REMOVABLE ROLLFEED APPARATUS AND METHOD by Lewis et al, now U.S. Pat. No. 5,815,186 discloses a unitary rollfeed apparatus that is pivotally mountable on the front of a free-standing printer. As can be seen in FIG. 1, this prior art rollfeed apparatus 1 comprises a substantial frame assembly having a number of strengthening and stiffening elements 2 and 3 in addition to means 4 and 5 for holding a roll of media. The whole of this large and unwieldy rollfeed apparatus must then be hung onto the front of the printer utilising mounting points 6 and 7 as described in the referenced application. Although the legs for the printer are not shown in FIG. 1, it should be noted that this prior art removable rollfeed apparatus can only be utilised with free-standing printers having legs and cannot be utilised with a desk-mountable printer.

BRIEF SUMMARY OF THE INVENTION

The present invention provides a modular rollfeed apparatus which is more easily attached and removed from a printer than prior art removable rollfeed apparatus. What is disclosed is a removable rollfeed apparatus adapted to be attached to a printer comprising a pair of rollfeed supports, each having means for holding an end of a media shaft, wherein each said rollfeed support is independently mountable on a printer. By providing a pair of independently mountable supports the present invention considerably eases the task of attaching or removing the rollfeed apparatus from a printer since only one relatively small support need be handled and aligned with the printer at a time. No strengthening or stiffening members are required between the two rollfeed supports since the printer itself provides sufficient structural integrity between the supports once they are mounted on the printer.

In a preferred embodiment, each rollfeed support comprises a first elongate portion and a second housing portion, said first elongate portion having means for releasably attaching to a printer and said second housing portion comprises means for holding an end of a media shaft. Furthermore, the rollfeed supports are preferably slidably mountable on the printer. This arrangement makes the independent attachment of each rollfeed support to the printer extremely easy. A tongue on the elongate portion of the rollfeed support may be aligned with a corresponding groove in the printer and the support simply slid into place. The rollfeed support may be retained in position by a single fixing means, for example one screw.

Although the rollfeed supports may be mounted elsewhere on the printer, for example on the sides of the printer, preferably they are mountable on the underside of the printer. In this case, the means for releasably attaching each rollfeed support are preferably located on an upper part of the support means and are designed to be able to support the weight of the printer. The rollfeed supports can thus be utilised with a free-standing printer or a desk-mountable printer.

A further aspect of the invention provides a simple method of attaching a rollfeed apparatus to a desk-mounted printer. One end of the printer is raised above the desk and a first rollfeed support is engaged at this end of the printer. This end of the printer is lowered to rest on the first rollfeed support and the other end of the printer is raised. A second rollfeed support is engaged at the other end of the printer and the printer is lowered to rest on both the first and second rollfeed supports. This method thus allows a rollfeed apparatus to be attached to a desk-mountable printer without the printer having to be turned upside down or placed on its back.

To ease the method of attaching the rollfeed apparatus still further the rollfeed supports are preferably slidably engageable with the underside of the printer.

A more complete understanding of the present invention and other objects, aspects, aims and advantages thereof will be gained from a consideration of the following description of the preferred embodiment read in conjunction with the accompanying drawings provided herein.

DETAILED DESCRIPTION OF THE PREFERRED EMBODIMENT OF THE INVENTION

Figure 1:
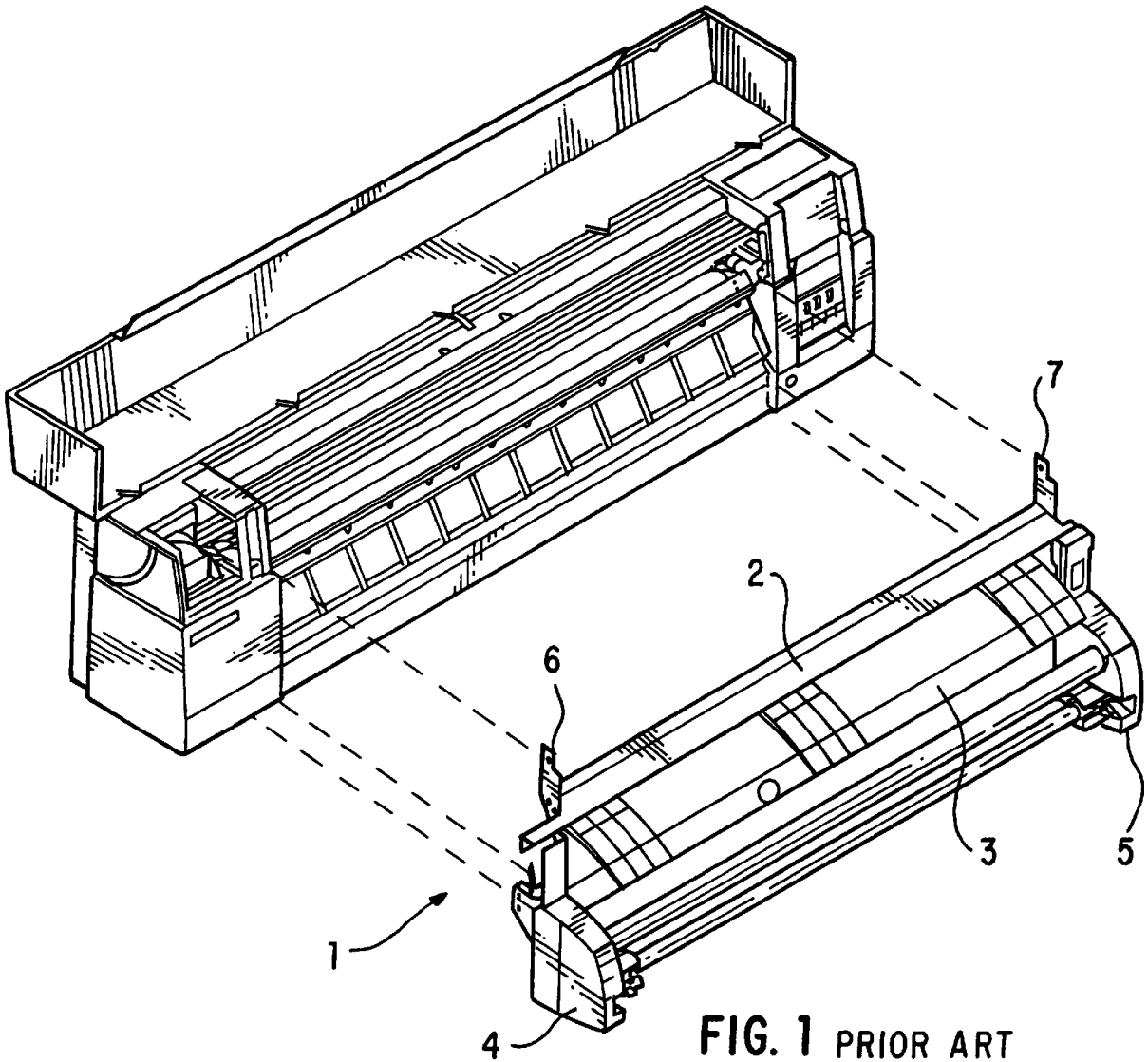
FIG. 1 PRIOR ART
FIG. 1 is a schematic perspective view of a prior art removable rollfeed apparatus and printer.

While the present invention is open to various modifications and alternative constructions, the preferred embodiments shown in the drawings will be described herein in detail. It is to be understood, however, that there is no intention to limit the invention to the particular form disclosed. On the contrary, the intention is to cover all modifications, equivalences and alternative constructions falling within the spirit and scope of the invention as expressed in the appended claims.

Figure 2A:
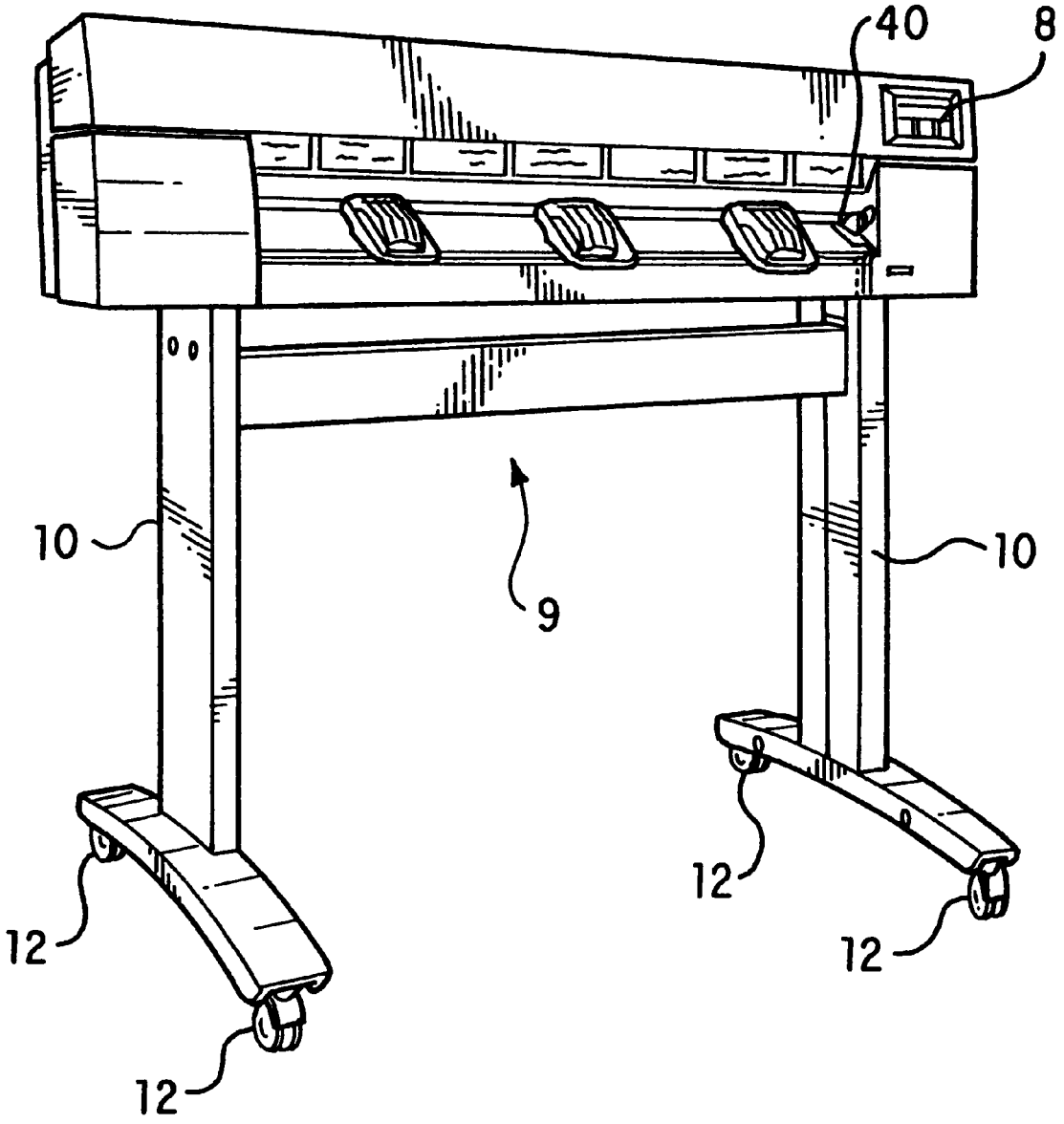
FIG. 2A is a schematic perspective view a free-standing printer having legs and FIG. 2B is a side view of the same printer.
Figure 2B:
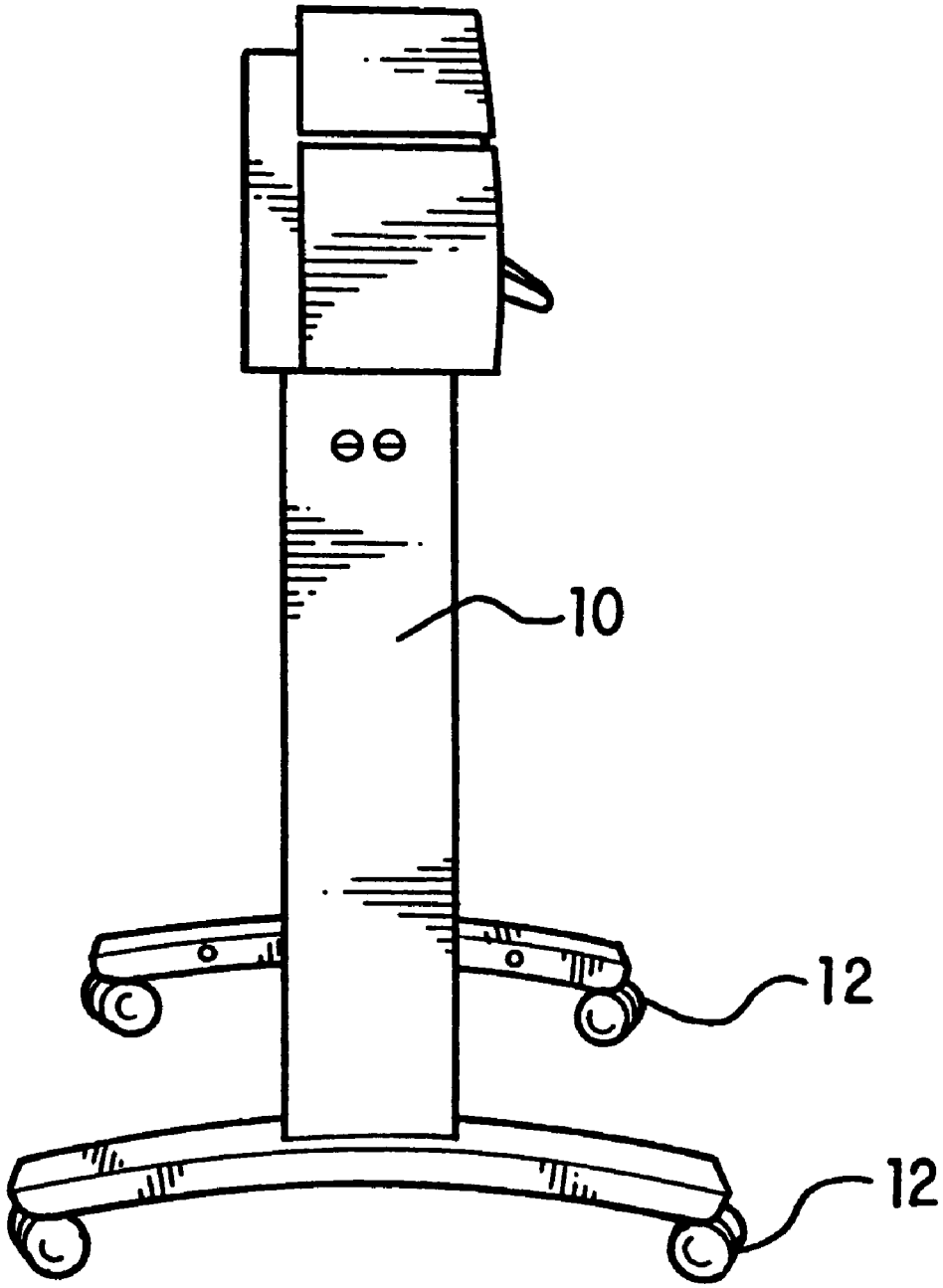
Figure 3A:
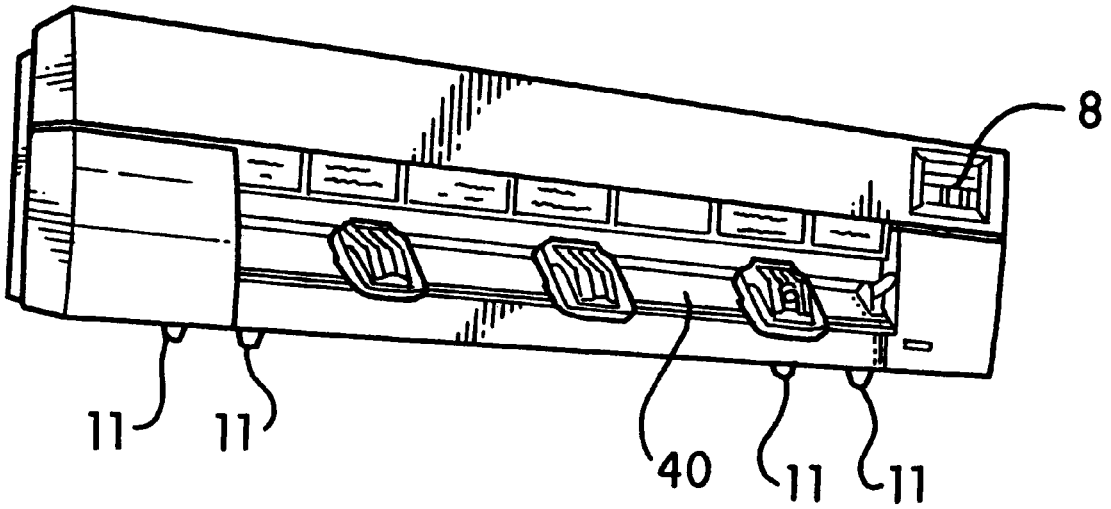
FIG. 3A is a schematic perspective view a desk-mountable printer having feet and FIG. 3B is a side view of the same printer.
Figure 3B:
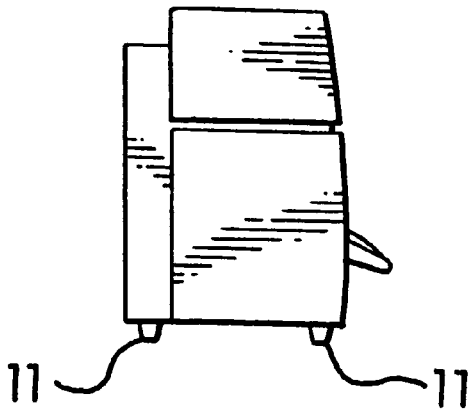

The rollfeed apparatus of the present invention operates in conjunction with a printer, for example an inkjet printer as shown in FIGS. 2A, 2B and 3A, 3B which does not have an integral rollfeed apparatus. FIGS. 2A and 2B show respectively a perspective and side view of a free-standing printer mounted on a stand 9 having legs 10 and wheels 12 while FIGS. 3A and 3B show respectively a perspective and side view of a desk-mountable printer having feet 11.

The printers include a control panel 8 having operating switches and lights to indicate the printers status and an entry platen 40 for receiving print media. These printers use inkjet technology to produce vibrant full colour or black and white outputs on various media in large-formats. Within the printers (not shown) are thermal inkjet cartridges mounted on a carriage for reciprocal motion on rods to allow the cartridge to move back and forth across a rotatable platen roller. Media moves around the platen in what can be termed the X-direction while the print carriage moves across the media in the Y-direction.

The Hewlett-Packard printers of the type just described are relatively inexpensive and are marketed to budget-conscious consumers. Thus, in a basic configuration the printers are intended to have media sheets fed one at a time through the printer. However, the printers may also accept media from a rollfeed apparatus which may be removably attached to the printer at the determination of an operator to allow the option of feeding the printer from a roll of media. The rollfeed apparatus of the present invention may be easily and quickly installed and removed from both the free-standing printer shown in FIGS. 2A and 2B and the desk-mountable printer shown in FIGS. 3A and 3B.

Figure 4A:
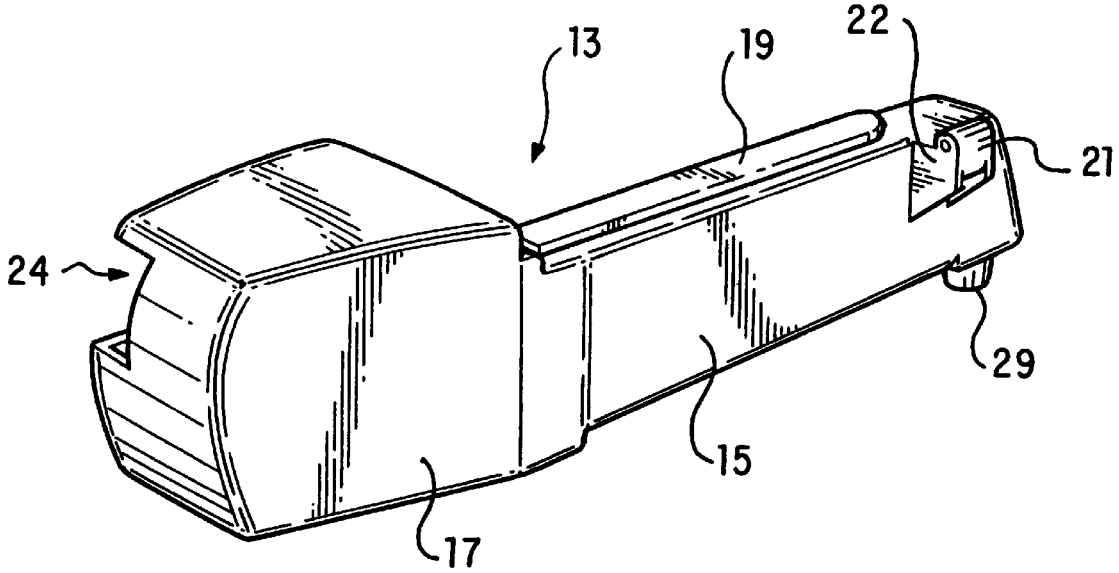
FIG. 4A is perspective view of the left side of a left rollfeed support.
Figure 4B:
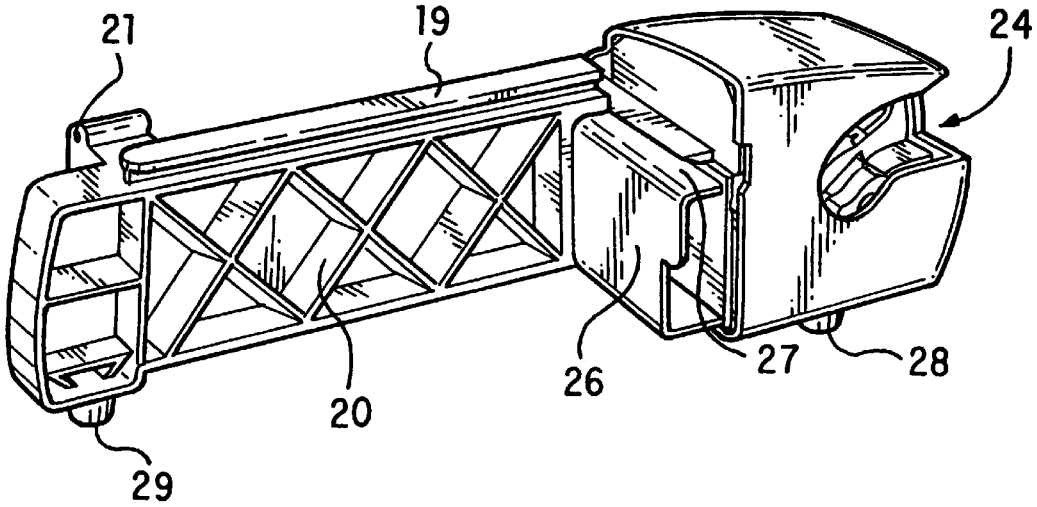
FIG. 4B is a perspective view of the right side of the same rollfeed support.
Figure 5A:
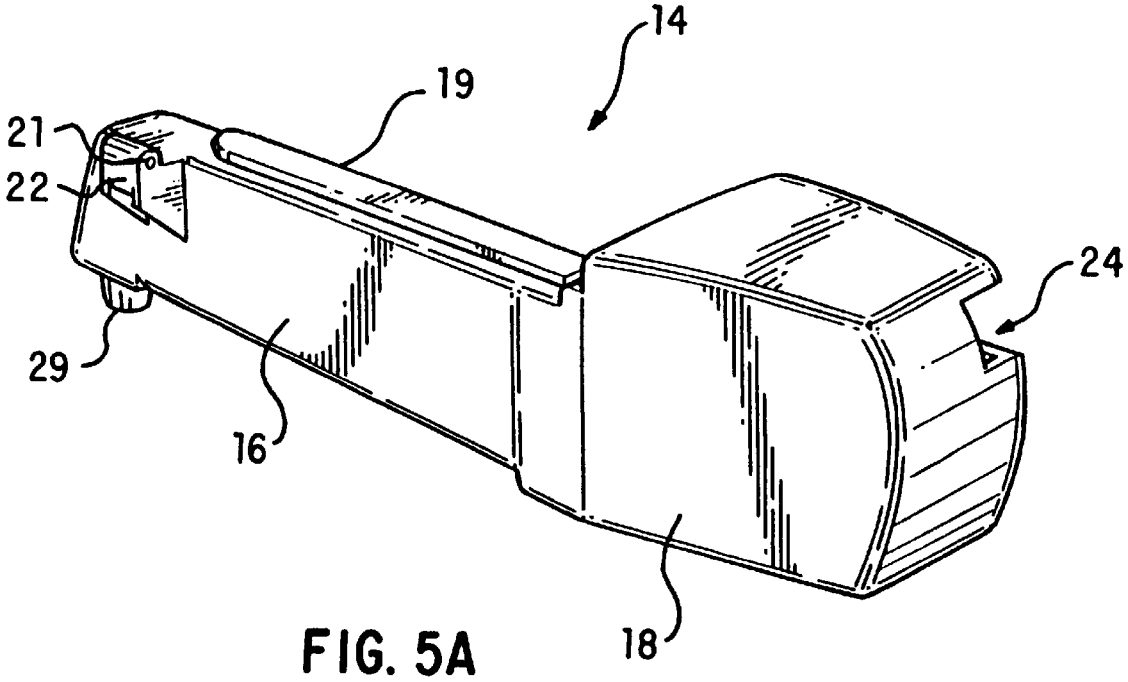
FIG. 5A is perspective view of the right side of a right rollfeed support.
Figure 5B:
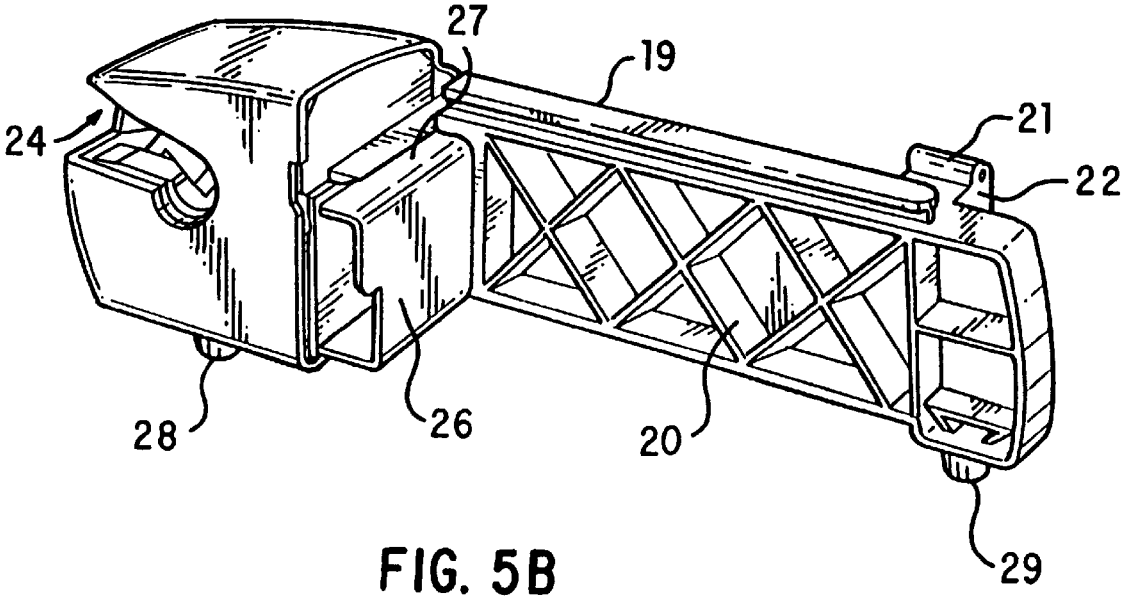
FIG. 5B is a perspective view of the left side of the same rollfeed support.
Figure 6B:
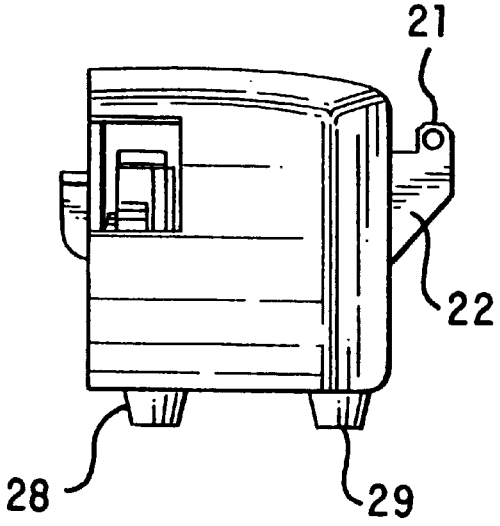
FIGS. 6A and 6B are respectively rear and front views of a left rollfeed support.
Figure 6A:
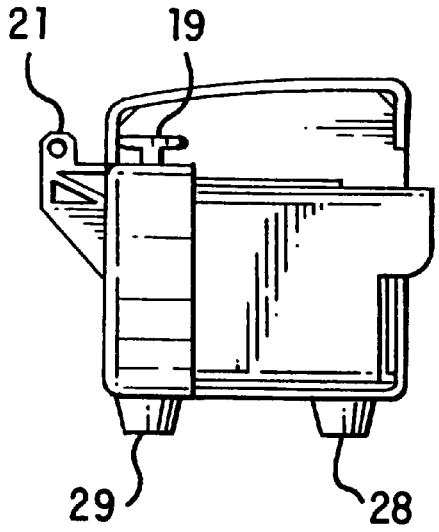
Figure 7A:
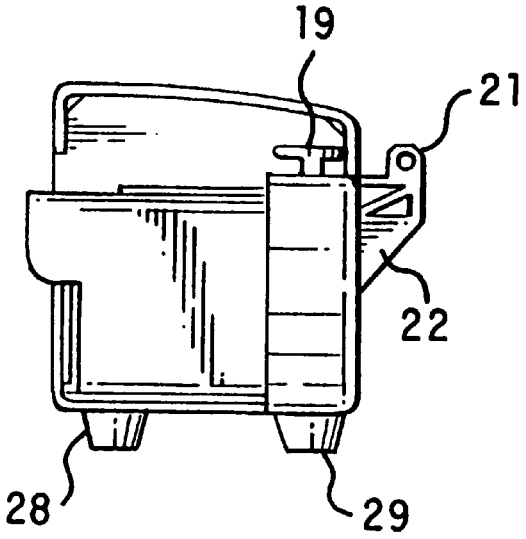
FIGS. 7A and 7B are respectively rear and front views of a right rollfeed support.
Figure 7B:
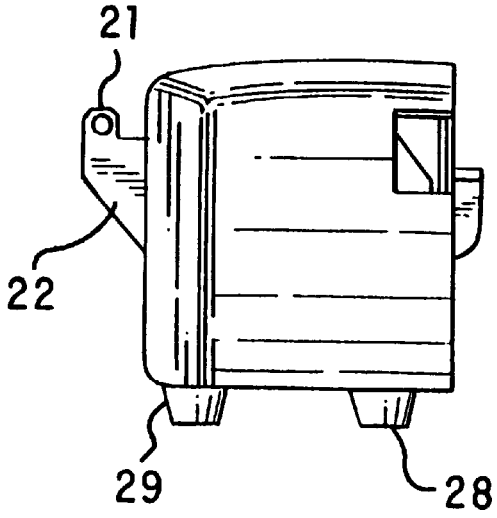

The rollfeed apparatus will now be described in detail with reference to FIGS. 4A, 4B and 5A, 5B and FIGS. 6A, 6B and 7A, 7B. The rollfeed apparatus comprises a pair of matched left and right rollfeed supports 13 and 14. The terms left and right are used herein relative to the printer itself, that is the left rollfeed support is attached to the left side of the printer (the side of the printer on an observers lefthand side when facing away from the printer). Each rollfeed support 13, 14 comprises an elongated portion 15, 16 and a housing portion 17, 18. On an upper part of each of the elongated portions 17, 18 there is a tongue 19 for engagement with a corresponding groove (described later) on the printer. The tongue 19 is curved at one end to facilitate entry into the groove on the printer and, as is best seen in FIGS. 6A and 7A, is of substantially T-shaped cross-section. The elongated portions 15, 16 have smooth faces on one of their sides, shown in FIGS. 5A and 4A, which are visible when the rollfeed supports are mounted on a printer and have numerous internal strengthening members 20 on their other sides, shown in FIGS. 4B and 5B, which are substantially not visible when the rollfeed apparatus is attached to a printer. At one end of each the elongate portions 15, 16 is an eyelet 21 on an arm 22 which extends somewhat away from the elongate portions 15, 16 as is best seen in FIGS. 6A, 6B and 7A, 7B. The eyelet is for receiving a fixing screw to fix the particular rollfeed support 13 or 14 to a printer as will be described later.

Figure 8:
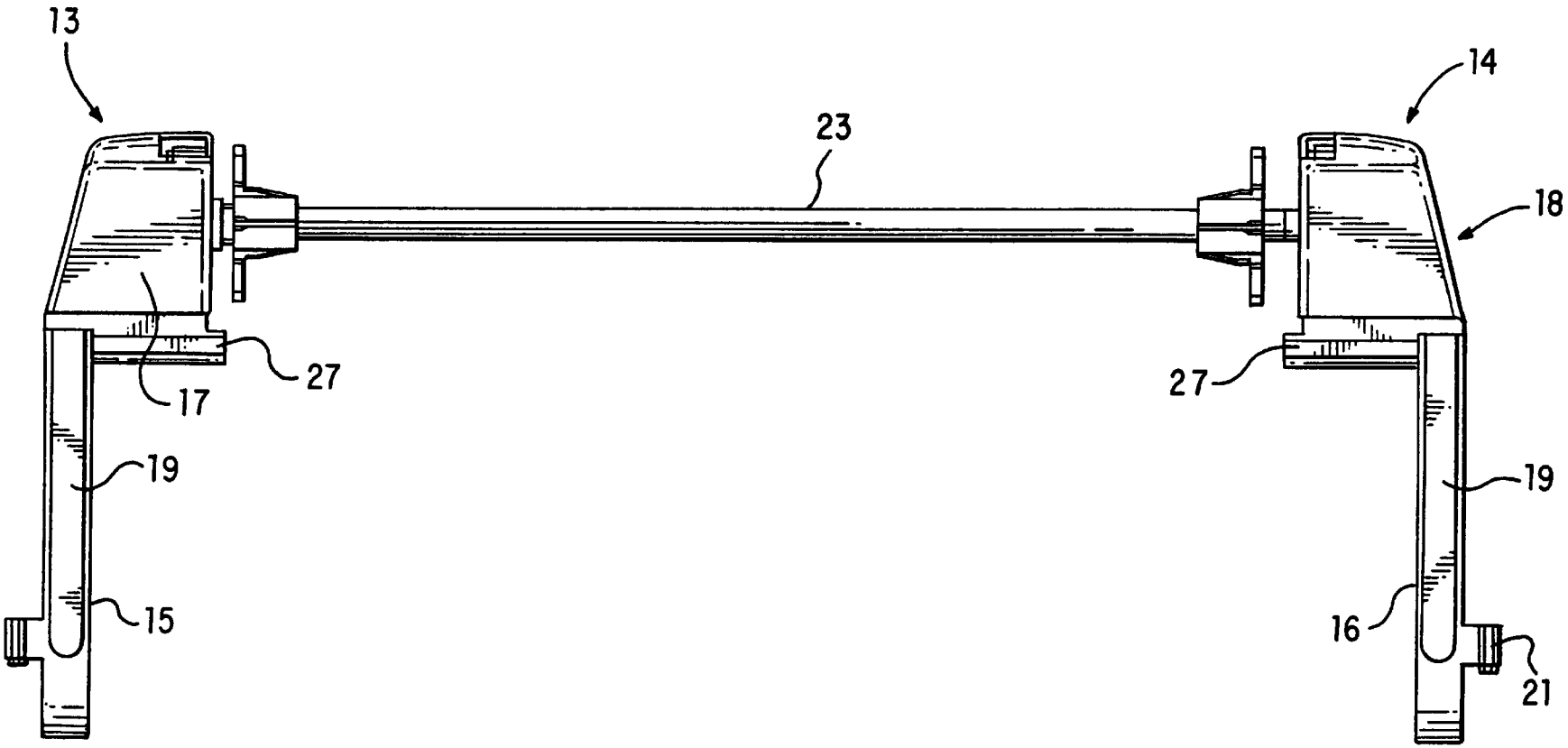
FIG. 8 is a plan view showing left and right rollfeed supports and a media shaft mounted between them.
Figure 9:
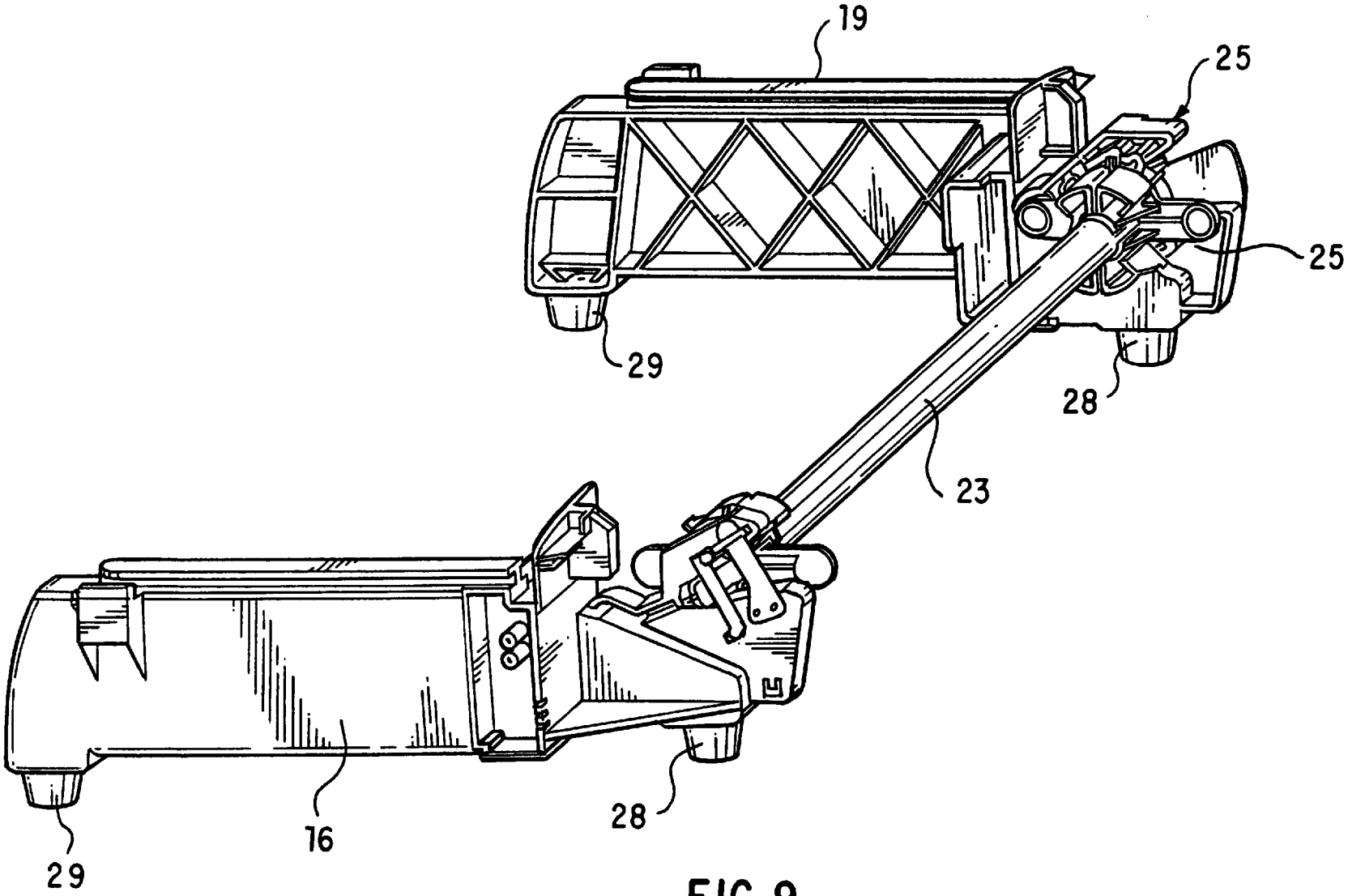
FIG. 9 is a perspective view of left and right rollfeed supports and a media shaft mounted between them in which the housing portion covers are not shown so that the media shaft holding means are seen.

FIGS. 8 and 9 show the two rollfeed supports with a media shaft 23 mounted between them for illustrative purposes alone, since in use the rollfeed supports need to be mounted on a printer prior to inserting the media shaft. The housing portions 17 and 18 of the rollfeed supports are generally cuboid and have a cover (which is shown removed in FIG. 9) for hiding from view the means for supporting each end of the media shaft 23. Each housing portion 17, 18 has a slot 24 into which an end of the media shaft 23 can be removably inserted and held. Hubs on each end of the media shaft 23 can be snapped into position in the slots 24 between arms 25 which are resiliently biased to grip, and in use brake, said hubs in a manner as for example is disclosed in commonly assigned application U.S. 08/658,346, filed Apr. 29, 1996, entitled REMOVABLE ROLLFEED APPARATUS AND METHOD by Lewis et al now U.S. Pat. No. 5,815,186 which application is incorporated herein by reference. As can best be seen in FIG. 8, the housing portions 17 and 18 of the rollfeed supports 13 and 14 extend substantially at right angles from the elongate portions 15 and 16 of the rollfeed supports so that when mounted on a printer the housing portions substantially face each other. This offset of the housing portions from the elongate portions also aids in positioning the means for holding an end of the media shaft further towards the print zone of the printer and avoids fouling of the elongate portions on the legs 10 of the printer, as will be better appreciated later. With reference to FIGS. 4B, 5B, and 8, towards the back of each of the housing portions 17 and 18 there is provided a structural extension 26 having an upper surface 27 for receiving the foot 11 of a printer.

Referring now to FIGS. 4, 5, 6, 7 and 9, each rollfeed support 13, 14 has a front foot 28 and a rear foot 29 which, when the rollfeed supports are attached to a desk-mountable printer, act as the feet for the whole printer. In this case the weight of the printer is borne partially by the tongue 19 and partially by the upper surface 27 of the structural extension 26 of the housing portions.

As can be appreciated from FIGS. 4, 5, 6 and 7, the two rollfeed supports are substantially mirror images of each other both structurally and visually. This reduces design and manufacturing costs and is also aesthetically pleasing.

Figure 10A:
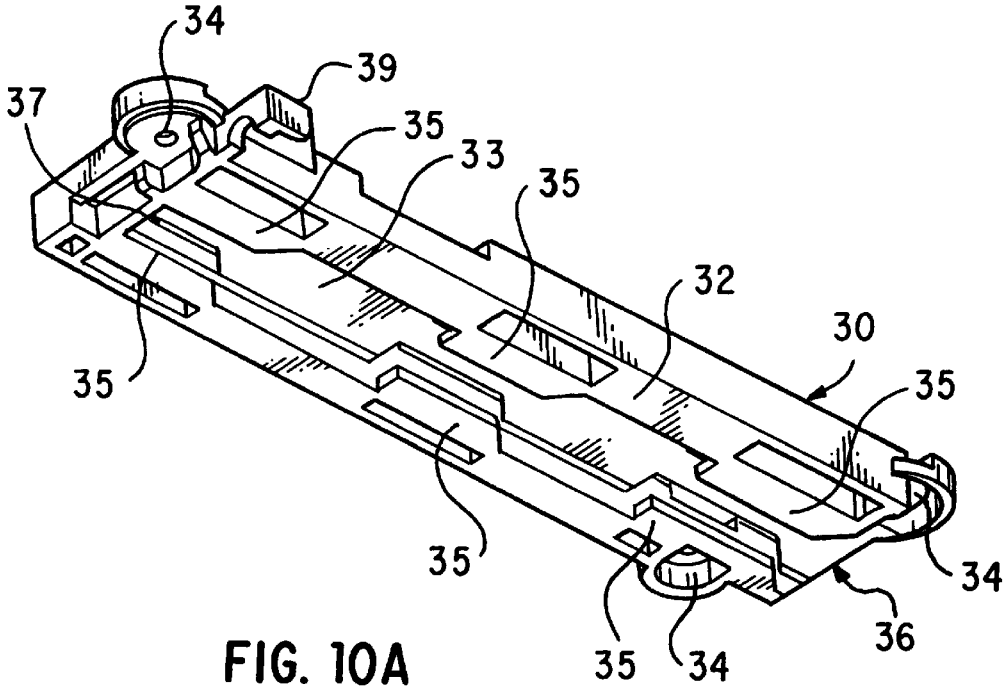
FIG. 10A is a perspective view of the lower side of a mounting plate and FIG. 10B is a perspective view of the upper side of the mounting plate.
Figure 10B:
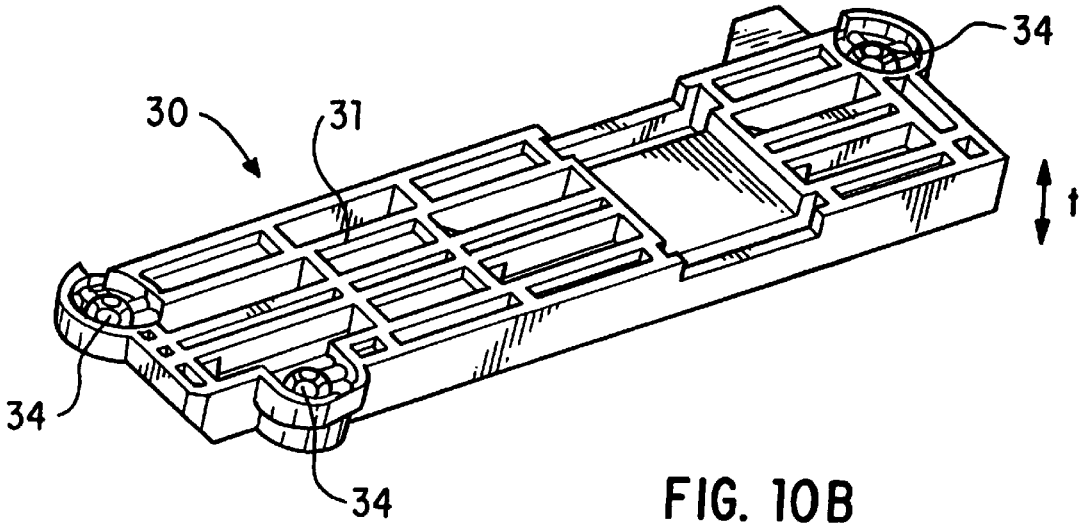

Although other mounting locations on a printer, for example on the sides of the printer, are envisioned, the specific embodiment described herein provides for the mounting of the rollfeed supports on the underside of the printer. The mounting arrangement will now be described in detail with reference to FIGS. 10, 11 and 12. A mounting plate 30 has an upper surface 31 shown in FIG. 10B which is mounted against the underside of a printer, and a lower surface 32 shown in FIG. 10A which has a groove 33 for receiving the tongue 19 of a rollfeed support. The upper surface 31 comprises numerous honeycomb-like structural segments to provide rigidity and low weight for a relatively thin plate. The mounting plate 30 is attached to the underside of a printer by means of screws locatable in the three holes 34 in the mounting plate. The groove 33 is formed by lands 35 of the plate periodically extending from each side of the plate 30. This construction of the groove 33 by lands 35 extending from each side facilitates the moulding of the mounting plate 30 from a plastics material. The groove 33 is open at one end 36, mounted towards the front of the printer, to allow entry of the tongue 19, and is closed by an endstop 37 at the other end to prevent the tongue 19 from leaving the mounting plate 30. The end 36 of the groove is flared slightly to ease the alignment and entry of the curved end of the tongue 19 into the groove. At the rear end of the mounting plate there is a half eyelet 39 for receiving a screw to retain the rollfeed support in place in the mounting plate 30. The eyelet 39 is not complete but rather comprises a half circle in order to keep the thickness of the mounting plate to a minimum. The thickness t of the mounting plate 30 is less than the length of the feet 11 of the printer so that when the plate is mounted on the underside of the printer, but the rollfeed supports are not attached to the printer, the printer will rest on its feet 11 and not on the mounting plate 30. The mounting plate 30 may be sold together with a pair of rollfeed supports and a media shaft as part of a rollfeed upgrade kit, but is preferably attached to the underside of all printers at the factory so that all printers are easily upgradable without the user needing to attach a mounting plate to the underside of their printer. The mounting plate may of course be integrally incorporated into the underside of the printer rather than being a separate component.

Figure 11:
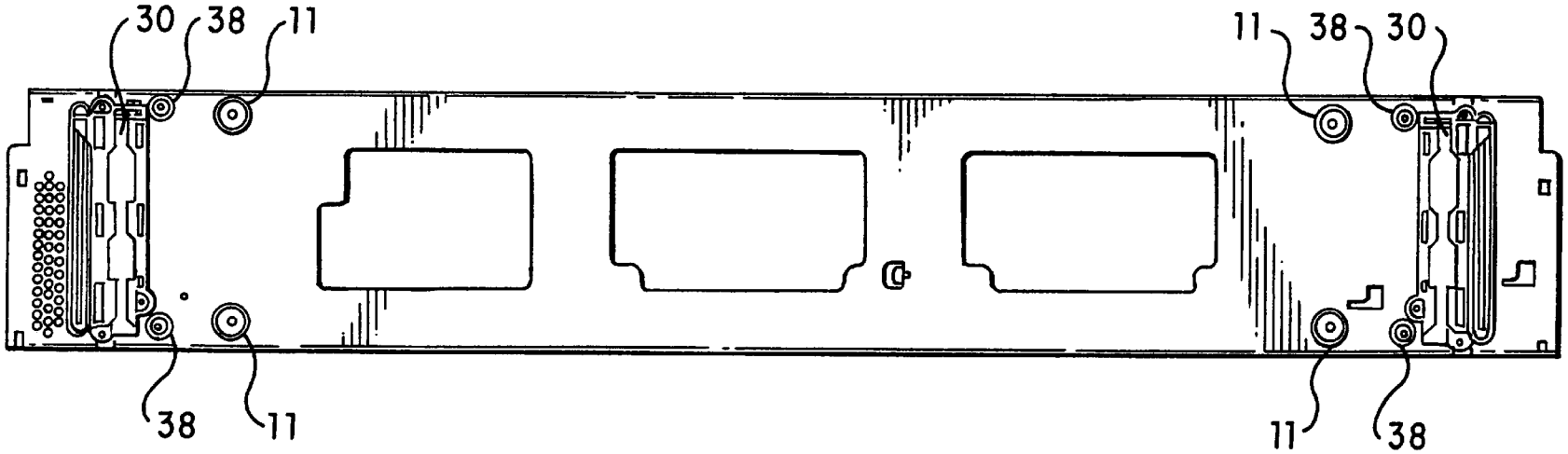
FIG. 11 is a plan view of the underside of a printer.
Figure 12:
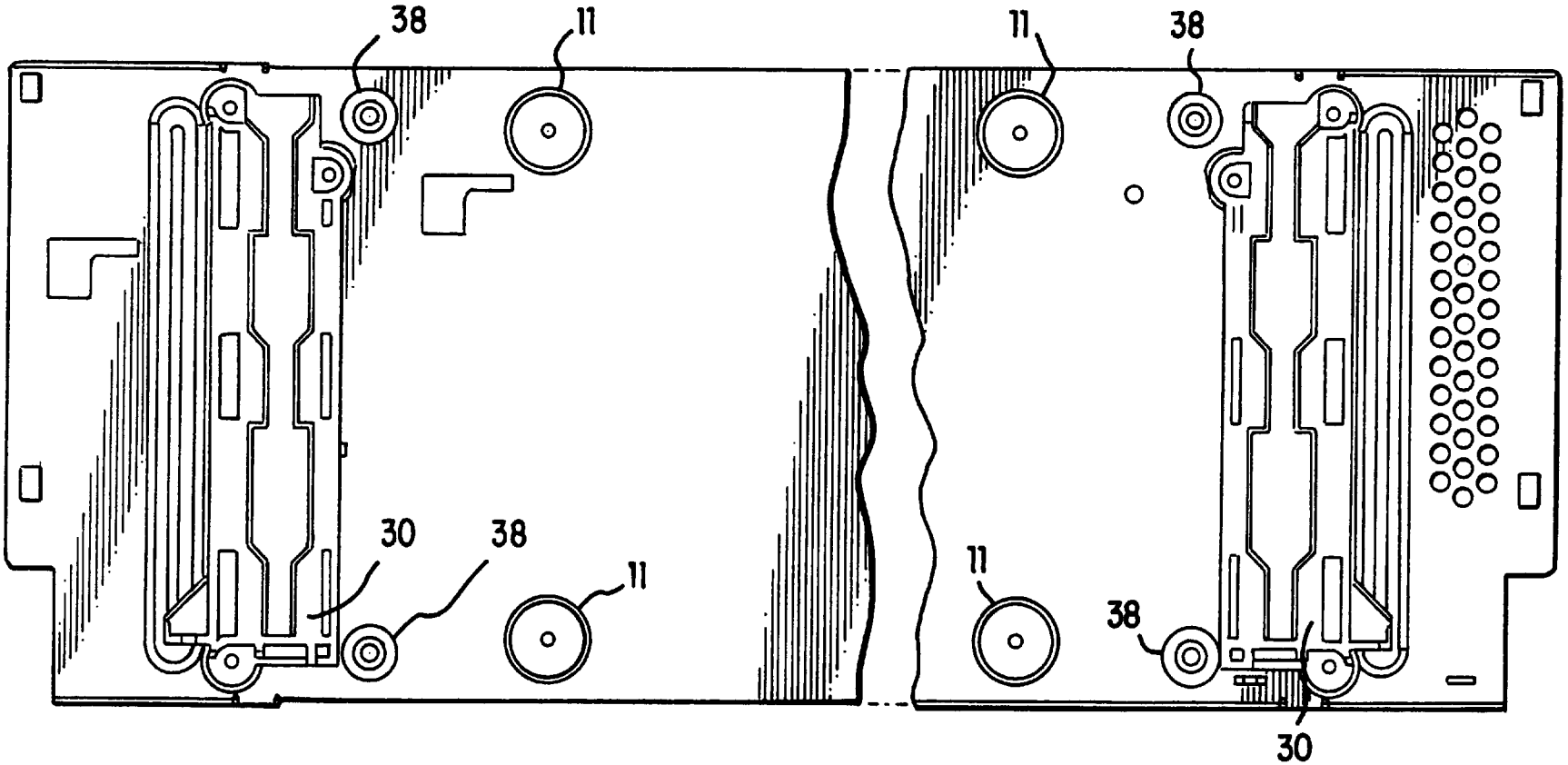
FIG. 12 is an exploded enlarged view of the end sections of the view of FIG. 11.

FIG. 11 is a plan view of the underside of a printer showing the location of four printer feet 11, four mounting points 38 for attaching legs to the printer to convert a desk-mountable printer to a free-standing printer and two mounting plates 30 for receiving a pair of rollfeed supports 13 and 14. As can be seen in the enlarged view of the two end sections of the underside of the printer shown in FIG. 12, the printer feet 11 are closest to the center of the printer, the mounting plates 30 are furthest from the center and the mounting points 38 for legs are intermediate these two locations. This order of the various mounting locations facilitates access to them by a user for example when attempting to attach rollfeed supports to a printer which has already had legs attached to it the user is still able to access the rollfeed support mounting plates 30 from both sides of the printer.

Figure 13:
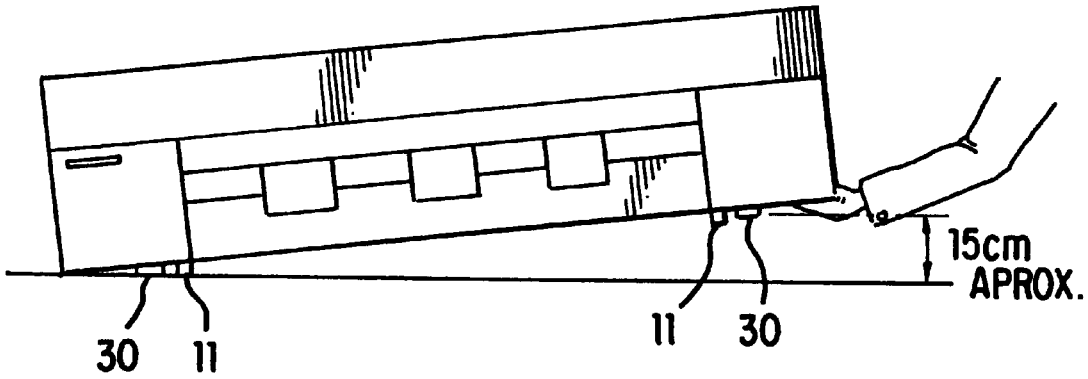
FIG. 13 is a schematic view of a step in the process of attaching a rollfeed support to a desk-mountable printer.
Figure 14:
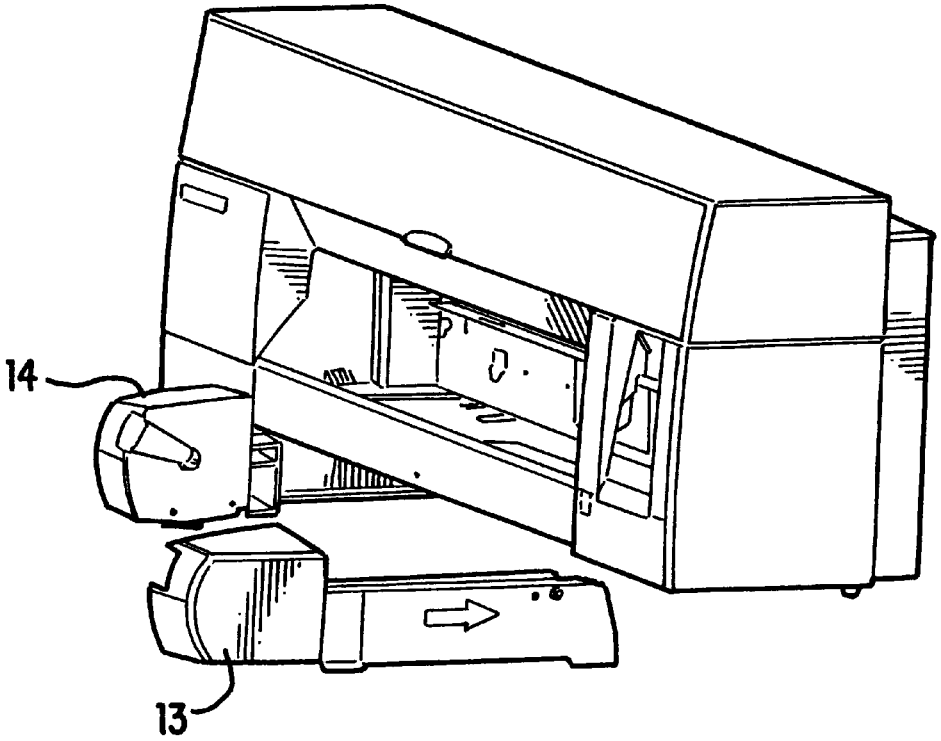
FIG. 14 shows a further step in the process of attaching a rollfeed support to a desk-mountable printer.
Figure 15:
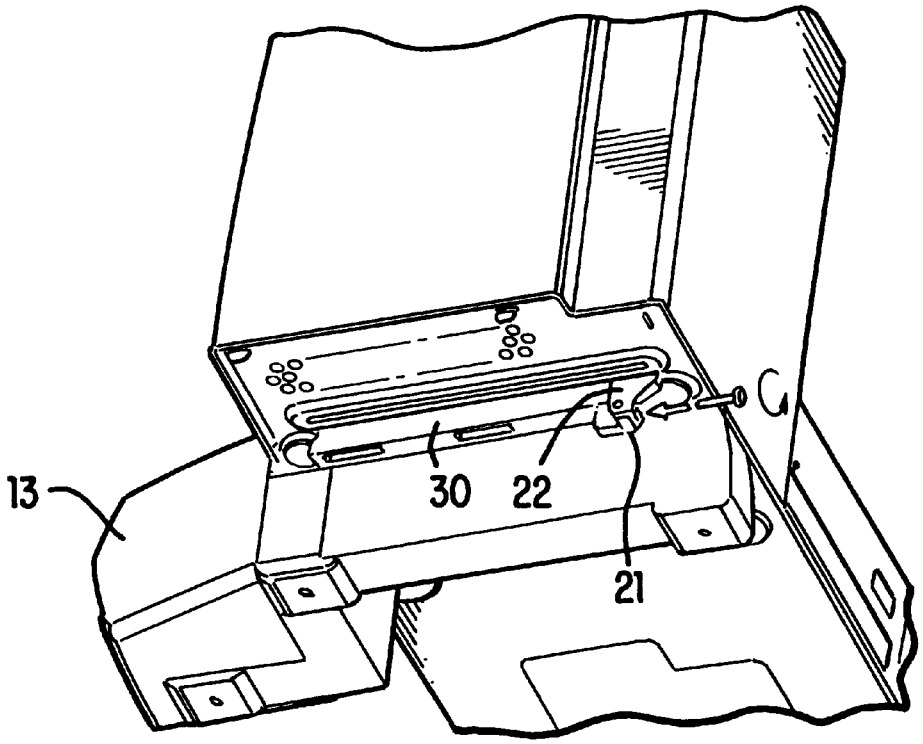
FIG. 15 shows the fixing of a rollfeed support to a mounting plate.

The technique for attaching rollfeed supports to a desk-mountable and free-standing printer will now be described with reference to FIGS. 13 to 19. For a desk-mountable printer firstly one end of the printer is raised slightly from the desk as shown in FIG. 13, only a height of approximately 15 cm is required. While the printer is in this position the appropriate rollfeed support (left or right) is slid into place under this end of the printer. This is achieved by simply placing the tongue 19 on the top of the elongate portion of the rollfeed into the opening 36 of the groove 33 in the mounting plate 30 at this end of the printer and pushing so that the tongue slides along the groove until it meets the endstop 37 of the groove. Once the first rollfeed support is fully located this end of the printer may be lowered to the desk so that it rests on the rollfeed support and the other end of the printer is raised. The second rollfeed support is similarly slid onto the underside of the printer at this other end as shown in FIG. 14 and this end can also be lowered to rest on the second rollfeed support. Finally, a single screw is placed through the half eyelet 39 of the mounting plate 30 and into the eyelet 21 on each rollfeed support, as shown in FIG. 15, in order to prevent the rollfeed support from sliding in the mounting plate. This finally fixture requires very little effort since it is not a load bearing fixture.

Figure 16:
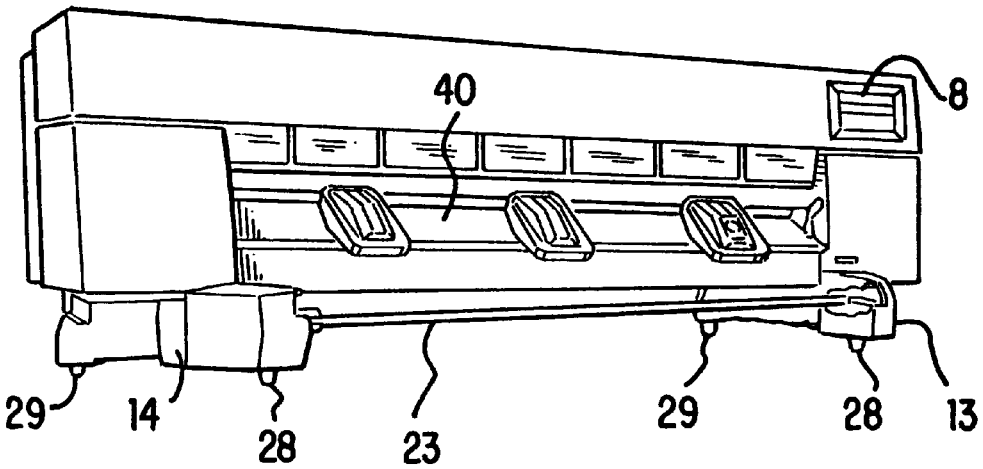
FIG. 16 is a perspective view of a desk-mountable printer with rollfeed apparatus attached.
Figure 17:
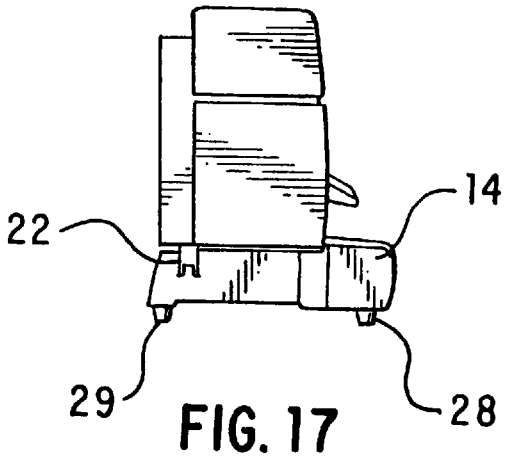
FIG. 17 is a side view of the printer of FIG. 16.
Figure 18:
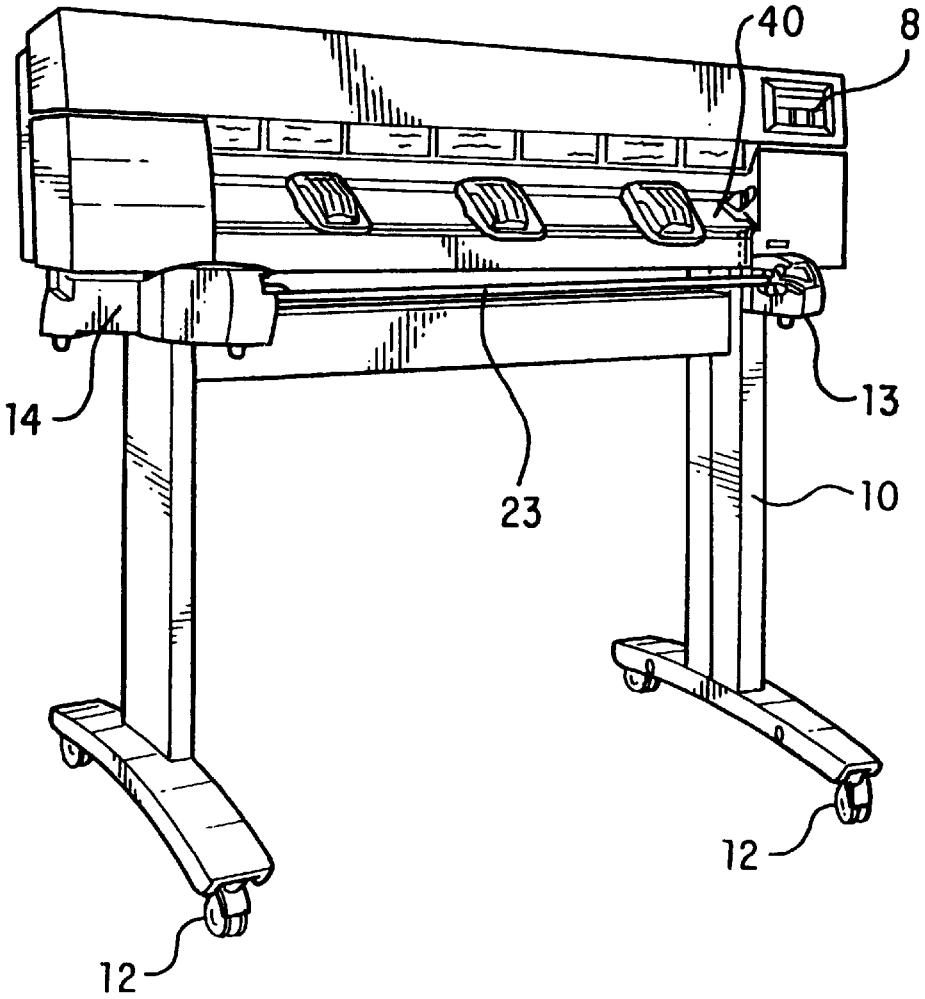
FIG. 18 is a perspective view of a free-standing printer with rollfeed apparatus attached.
Figure 19:
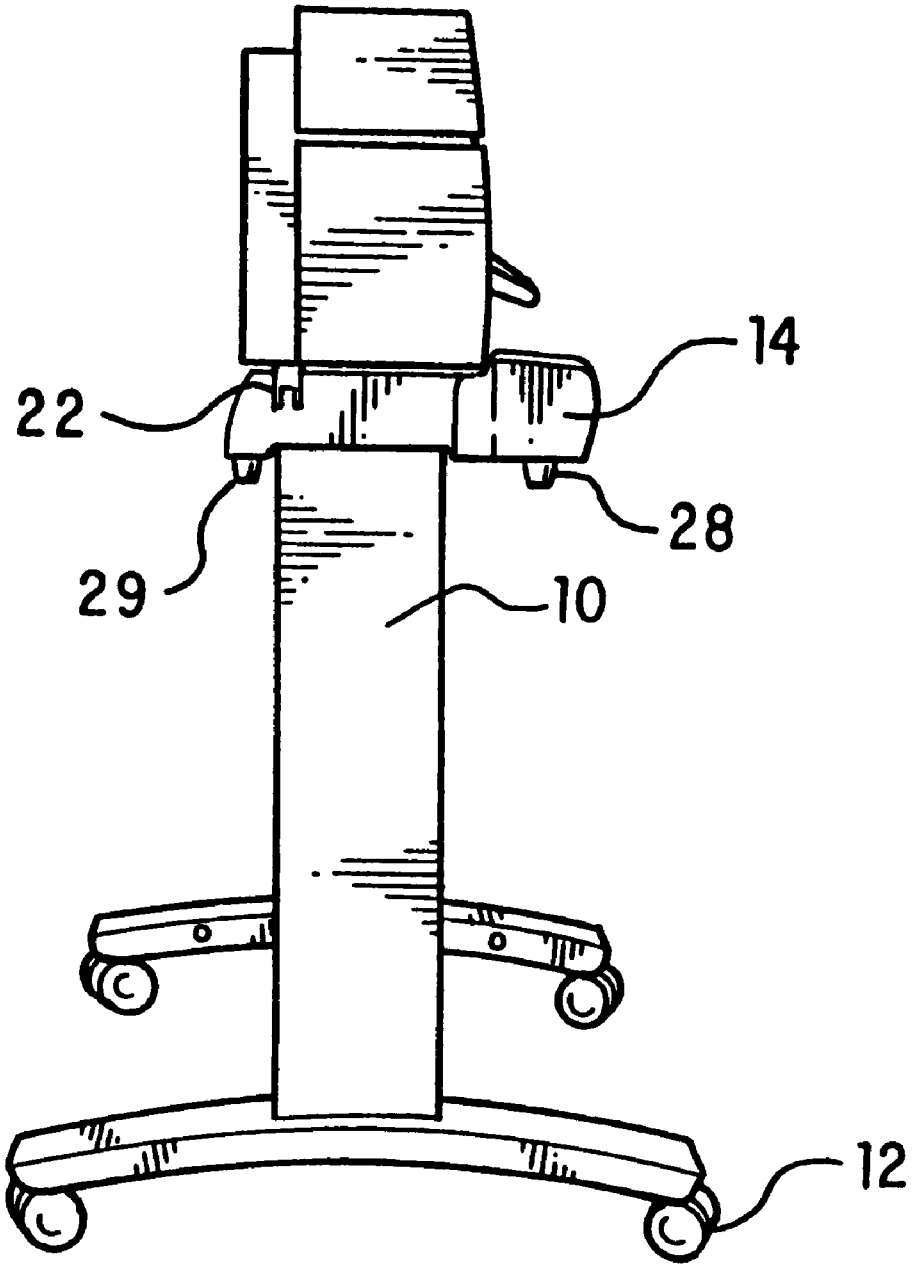
FIG. 19 is a side view of the printer of FIG. 17.

FIG. 16 shows a perspective view of a desk-mountable printer with a pair of rollfeed supports 13 and 14 attached and a media shaft 23 in place between the rollfeed supports. As can be seen the media shaft 23 is held in front of and slightly below the media entry platen 40 of the printer, which is the ideal position for the shaft. In this configuration the weight of the printer is spread between the tongues 19, and the structural extensions 26 of the housing portions of both rollfeed supports 13 and 14 and the only contact with the desk is via the four rollfeed support feet 28 and 29 as can be seen from the side view shown in FIG. 17.

The attachment of a pair of rollfeed supports to a free-standing printer is even easier. The process is substantially identical to that described above for attachment to a desk-mountable printer except that since the printer is raised from the ground by legs 10 the raising step is not necessary to access the mounting plates. Hence, respective left and right rollfeed supports 13 and 14 are simply slid onto the mounting plates 30 at each end of the printer (which are located so that this can be done without fouling on the legs 10) and a screw is placed at each end through the half eyelet 39 as described above. As can be seen from FIGS. 18 and 19 the same ideal position of an inserted media shaft 23 is achieved.

A printing system has thus been described which can be easily, simply and quickly be configured as any one of the following: a desk-mounted printer without rollfeed apparatus attached, a desk-mounted printer with rollfeed apparatus attached, a free-standing printer without rollfeed apparatus attached, or a free-standing printer with rollfeed apparatus attached.

What is claimed is:

1. A removable rollfeed apparatus for attachment to a printer, said rollfeed apparatus comprising a pair of independent rollfeed supports for supporting a media shaft having a first and second end, each rollfeed support having means for holding said first or second end of said media shaft, wherein each said rollfeed support is independently mountable directly on the printer to be separately attachable to or removable from the printer.

2. A rollfeed apparatus as claimed in claim 1, wherein each rollfeed support comprises a housing portion and a relatively elongate portion, said elongate portion having means for releasably attaching to a printer and said housing portion comprising means for holding said first or second end of said media shaft.

3. A rollfeed apparatus as claimed in claim 2, wherein each rollfeed support comprises slidable mounting means for slidably mounting said rollfeed support to the printer and said printer comprises receiving means for receiving said slidable mounting means.

4. A rollfeed apparatus as claimed in claim 2, wherein said housing portion of each rollfeed support extends a fixed length at substantially a right angle from said elongate portion of each rollfeed support, and wherein a first of said pair of rollfeed supports is in appearance a substantial mirror image of a second of said pair of rollfeed supports so that when mounted on a printer the housing portion of each rollfeed support substantially face each other.

5. A rollfeed apparatus as claimed in claim 3, wherein the printer receiving means comprises a groove and said rollfeed apparatus slidable mounting means comprise a tongue for slidable engagement with said groove in said printer.

6. A rollfeed apparatus as claimed in claim 5, wherein said tongue extends along a substantial part of said elongate portion of each rollfeed support.

7. A rollfeed apparatus as claimed in claim 6, wherein said tongue and groove arrangement is sufficient to retain the rollfeed supports in an operational position on the printer and said means for releasably attaching each rollfeed support further comprises a single fixing means for fixing the rollfeed support, when said support is in an operational position so as to prevent sliding of the tongue within the groove.

8. A rollfeed apparatus as claimed in claim 5, wherein the printer comprises an underside which, when the printer is in an operational position, is a side of the printer closest to a ground surface and wherein the rollfeed supports are mountable on said underside of said printer.

9. A method of attaching a rollfeed apparatus to a desk-mounted printer, having a first and a second end, said rollfeed apparatus comprising a first and a second rollfeed support, the method comprising the steps of:

raising said first end of the printer, attaching said first rollfeed support at said first end of the printer, and lowering the printer to rest on said first rollfeed support, then raising said second end of the printer, attaching said second rollfeed support at said second end of the printer, and lowering the printer to rest on said first and second rollfeed supports.

10. A method of attaching a rollfeed apparatus as claimed in claim 9, wherein both said attaching steps comprise slidably engaging each rollfeed support at each end of the printer.

11. A method of attaching a rollfeed apparatus as claimed in claim 9, wherein both said attaching steps comprise engaging each rollfeed support to the underside of the printer at each end of the printer.

12. A removable rollfeed apparatus for attachment to a printer, comprising:

a printer having an underside which, when the printer is in an operational position, is a side of the printer closest to a ground surface;

a rollfeed apparatus having a pair of independent rollfeed supports for supporting a media shaft having a first and second end, each rollfeed support having means for holding said first or second end of said media shaft;

wherein each said rollfeed support is independently mountable on said underside of said printer, and further comprises slidable mounting means for releasably attaching said rollfeed support to said printer so as to be load bearing and able to partially support a weight of said printer, said printer comprising receiving means for receiving said slidable mounting means; and wherein said printer receiving means comprises a groove and said rollfeed apparatus slidable mounting means comprises a tongue for slidable engagement with said groove in said printer.

13. A rollfeed apparatus as claimed in claim 12, wherein said tongue is substantially T-shaped in cross-section.

14. A removable rollfeed apparatus for attachment to a printer, comprising:

a printer having an underside which, when the printer is in an operational position, is a side of the printer closest to a ground surface;

a rollfeed apparatus having a pair of independent rollfeed supports for supporting a media shaft having a first and second end, each rollfeed support having a housing portion for holding said first or second end of said media shaft, said housing portion having an upper part which, when the rollfeed support is in an operational position, is a part of the housing positioned furthest from a ground surface and wherein said printer includes a downwardly extending foot on said underside of the printer and said upper part of the housing portion is engageable with said foot and is able to partially support a weight of the printer;

wherein each said rollfeed support is independently mountable on said underside of said printer, and further comprises slidable mounting means for slidably mounting said rollfeed support to said printer, said printer comprising receiving means for receiving said slidable mounting means; and wherein said printer receiving means comprises a groove and said rollfeed apparatus slidable mounting means comprises a tongue for slidable engagement with said groove in said printer.

15. A method of attaching a rollfeed apparatus to a free-standing printer comprising:

providing a printer with a first and second end, and having legs holding the printer spaced above a ground surface, with mounting guides on an underside of the printer on the first and second ends, respectively;

providing first and second modular rollfeed supports;

removably attaching the first modular rollfeed support to the printer by slidably mounting the first modular rollfeed support to one of the mounting guides;

removably attaching the second modular rollfeed support to the printer by slidably mounting the second modular rollfeed support to another of the mounting guides; and placing a media shaft in operational position on said first and second modular rollfeed supports.

16. The method of claim 15 wherein said first and second modular rollfeed supports are attached by said removably attaching steps one at a time.

17. The method of claim 15 wherein said first and second modular rollfeed supports are attached by said removably attaching steps without having to remove the legs from the printer.

* * * * *